US009108075B2

(12) United States Patent
Seman

(10) Patent No.: US 9,108,075 B2
(45) Date of Patent: Aug. 18, 2015

(54) LINEMAN'S POLE STRAP ASSEMBLY

(75) Inventor: Michael R. Seman, Cranberry Township, PA (US)

(73) Assignee: Honeywell International Inc., Morristown, NJ (US)

( * ) Notice: Subject to any disclaimer, the term of this patent is extended or adjusted under 35 U.S.C. 154(b) by 187 days.

(21) Appl. No.: 13/473,179

(22) Filed: May 16, 2012

(65) Prior Publication Data

US 2012/0292129 A1 Nov. 22, 2012

Related U.S. Application Data

(60) Provisional application No. 61/487,507, filed on May 18, 2011, provisional application No. 61/489,156, filed on May 23, 2011.

(51) Int. Cl.
*A62B 35/00* (2006.01)

(52) U.S. Cl.
CPC ..... *A62B 35/0006* (2013.01)

(58) Field of Classification Search
CPC .... A63B 27/00; A63B 35/00; A63B 35/0075; A63B 35/0068
USPC ..... 182/3, 9, 133
See application file for complete search history.

(56) References Cited

U.S. PATENT DOCUMENTS

| | | | | | |
|---|---|---|---|---|---|
| 869,382 | A * | 10/1907 | Newton | 182/9 |
| 1,120,496 | A | 12/1914 | Hiksclaw | |
| 1,721,516 | A * | 7/1929 | Jacobs | 182/9 |
| 2,920,714 | A | 1/1960 | Johnson | |
| 3,407,898 | A | 10/1968 | Johnson | |
| 3,840,091 | A * | 10/1974 | Conlon | 182/9 |
| 4,579,196 | A * | 4/1986 | Allen et al. | 182/9 |
| 4,712,646 | A | 12/1987 | Page | |
| 5,137,113 | A * | 8/1992 | Lortie | 182/9 |
| 5,141,074 | A * | 8/1992 | Sulowski et al. | 182/9 |
| 5,184,696 | A * | 2/1993 | Meed et al. | 182/9 |
| 5,234,074 | A * | 8/1993 | Bell | 182/9 |
| 6,357,547 | B1 * | 3/2002 | Kellog et al. | 182/9 |
| 6,581,726 | B1 * | 6/2003 | Petzl et al. | 182/7 |
| 6,644,438 | B1 * | 11/2003 | Chang et al. | 182/9 |
| 2010/0051382 | A1 * | 3/2010 | Schlief | 182/9 |
| 2010/0078261 | A1 | 4/2010 | Watts et al. | |
| 2010/0089694 | A1 * | 4/2010 | Paul | 182/9 |
| 2011/0214941 | A1 * | 9/2011 | Petty et al. | 182/9 |
| 2011/0290586 | A1 * | 12/2011 | Goldmann et al. | 182/3 |

OTHER PUBLICATIONS

International Preliminary Report on Patentability dated Nov. 19, 2013.

* cited by examiner

*Primary Examiner* — Charles A Fox
*Assistant Examiner* — Kristine Florio
(74) *Attorney, Agent, or Firm* — Wood, Phillips, Katz, Clark & Mortimer

(57) ABSTRACT

A pole strap assembly (10) is provided for use in climbing a utility pole (22), and includes an outer strap (12) including opposite end portions (32,34) connected by an intermediate portion (20); and an elongate wear member (30) attached to and extending over at least part of the intermediate portion (20) of the outer strap (12), wherein the wear member (30) does not extend over the end portions (32,34), and the outer strap (12) has a total length $L_O$ and the elongate wear member (30) has a length $L_I$, with the length $L_O$ being no greater than twice the length $L_I$.

14 Claims, 9 Drawing Sheets

LINEMAN'S POLE STRAP ASSEMBLY

CROSS-REFERENCE TO RELATED APPLICATIONS

This application claims the benefit of the filing date of U.S. Provisional Application No. 61/487,507, filed May 18, 2011 and Provisional Application No. 61/489,156, filed May 23, 2011, which are hereby incorporated by reference.

FEDERALLY SPONSORED RESEARCH OR DEVELOPMENT

Not Applicable.

MICROFICHE/COPYRIGHT REFERENCE

Not Applicable.

FIELD

This invention relates to an improved pole strap assembly for use by a lineman.

BACKGROUND

A conventional pole strap is generally of relatively stiff but flexible material and is attached by snap hooks at its ends to rings on the lineman's body belt. In use the pole strap is passed round the far side of the utility pole or the like to be climbed and supports the lineman at a working position. When climbing the pole, or descending, the lineman adopts a side to side rolling movement while flipping the strap up and down between successive positions as he climbs up or down the pole. In order to support the lineman if he loses his footing on the pole, such pole straps are commonly fitted with braking means which are intended to engage the pole and support the lineman while he regains his footing.

Various safety devices having braking features have been proposed for braking the fall of a lineman. Such devices are described, for example, in U.S. Pat. No. 869,382 (Newton), U.S. Pat. No. 1,120,496 (Holsclaw), U.S. Pat. No. 1,721,516 (Jacobs), U.S. Pat. No. 2,920,714 (Johnson), U.S. Pat. No. 3,407,898 (Johnson), U.S. Pat. No. 3,840,091 (Conlon), U.S. Pat. No. 4,579,196 (Allen) and U.S. Pat. No. 4,712,646 (Page). Many of these devices rely up the use of biting elements which are positioned so as to bite into the wood of the utility pole in the event of a fall, thereby supporting the lineman while he regains his footing. However, such devices are not effective unless the biting elements are brought into contact with the surface of the pole. To this end the pole strap is generally fitted with a cross-strap extending across the near face of the pole, the assembly forming a closed loop encircling the pole and adapted to engage the pole snugly in the event of a fall.

U.S. Pat. No. 5,141,074 (Sulowski et al) discloses a lineman's pole strap assembly including an outer strap of relatively stiff but flexible material adapted to extend loosely around the far side of a pole to be climbed and having end portions providing attachment means for attachment to a body belt worn by a lineman, and a cross strap which is secured at its ends to slide members slidably mounted on the outer strap so as to define with an intermediate portion of the outer strap a closed loop for encircling the pole. The slide members have integral gaffs and are interconnected by an elastic tensile or bias member, such as a coil spring or a bungee cord, which extends around the intermediate portion of the outer strap along its outer surface. In normal ascent or decent of the pole the lineman holds the cross strap away from the pole with his hands while employing the pole strap in the conventional way. If he loses his footing, he releases the cross strap, which is automatically drawn into frictional engagement with the pole by the elastic tensile member. In this way the closed loop formed by the cross strap and the outer strap is tightened onto the pole to ensure that the integral gaffs on the slide members bite the pole and support the lineman while footing is regained. Commercial embodiments based on the concepts disclosed in U.S. Pat. No. 5,141,074 are offered by Honeywell under the Miller® brand as StopFall™ Fall Restraint System Product.

SUMMARY

An improved pole strap assembly is described herein and provides numerous advantages not known in the art.

In one feature, a pole strap assembly is provided for use in climbing a utility pole, the assembly comprising and includes an outer strap to wrap around a far side of a pole; a pair of slides mounted to translate along the outer strap; a cross strap to extend across a near side of a pole, the cross strap having a first end carried on one of the slides to allow movement of the first end along the outer strap and an opposite end carried on the other of the slides to allow movement of the opposite end along the outer strap; at least one bias member mounted between the slides and the outer strap to urge translation of the slides toward each other along the outer strap; and at least one elongate protective cover fixed on the outer strap and extending over the at least one bias member. The protective cover includes first and second elongate wall members fixed to the outer strap along opposite lateral sides of the at least one bias member, with the first and second elongate members having a first state wherein they are connected to each other to extend over the at least one bias member and a second state wherein they are disconnected from each other to allow inspection of the at least one elongate bias member.

As one feature, a pole strap assembly is provided for use in climbing a utility pole and includes an outer strap to wrap around a far side of a pole, the outer strap having opposite ends; a pair of adjustable strap assemblies fixed to the opposite ends of the outer strap and having adjustable lengths, each of adjustable strap assemblies including a tension buckle fixed to one of the opposite ends of the outer strap, a releasable connector to connect to a harness or belt worn by a user, and an adjustment strap extending between the tension buckle and the releasable connector. The adjustment strap has an end threaded through a bite on the tension buckle to extend toward the releasable connector such that movement of the end toward the releasable connector shortens the length of the adjustable strap assembly.

According to one feature, a pole strap assembly is provided for use in climbing a utility pole and includes an outer strap to wrap around a far side of a pole and an elongate wear member attached to and extending over part of the outer strap to engage the far side of the pole. The outer strap has a total length $L_O$ and the elongate wear member has a length $L_I$, with length $L_O$ being no greater than twice the length $L_I$.

In one feature, a pole strap assembly is provided for use in climbing a utility pole and includes an outer strap to wrap around a far side of the pole, and a cross strap connected to the outer strap to wrap around a near side of the pole, the cross strap having a first end attached to a right hand side of the outer strap and a second end extending through a cam buckle fixed to a left hand side of the outer strap, the second end threaded through a bite on the cam buckle to extend toward the right hand side of the outer strap.

Other features and advantages of the invention will become apparent from a review of the entire specification, including the appended claims and drawings.

DETAILED DESCRIPTION OF THE PREFERRED EMBODIMENT

Figure 1:
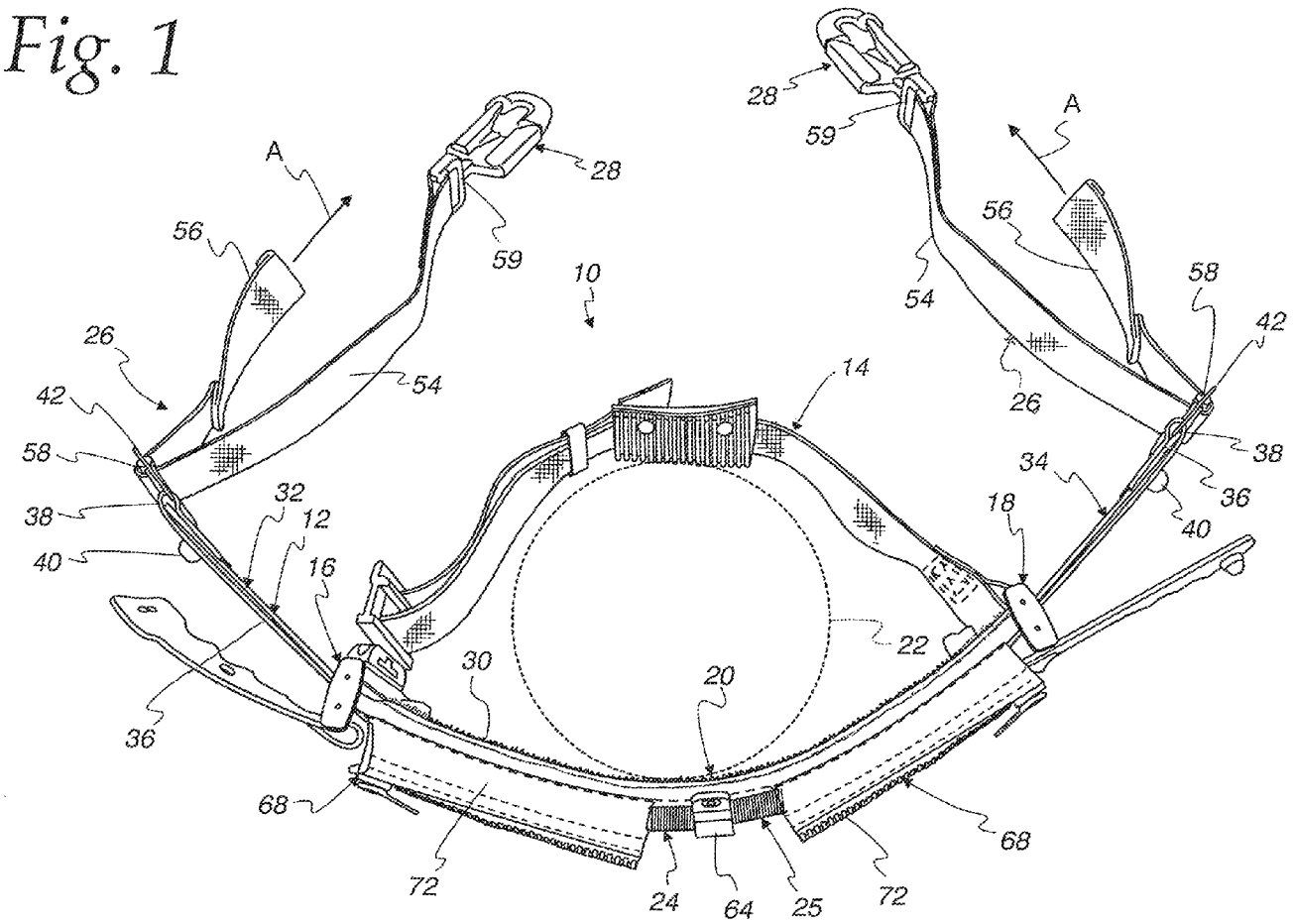
FIG. 1 is a view from above of a pole strap assembly generally arranged as it would be during use by a lineman or other user.
Figure 2:
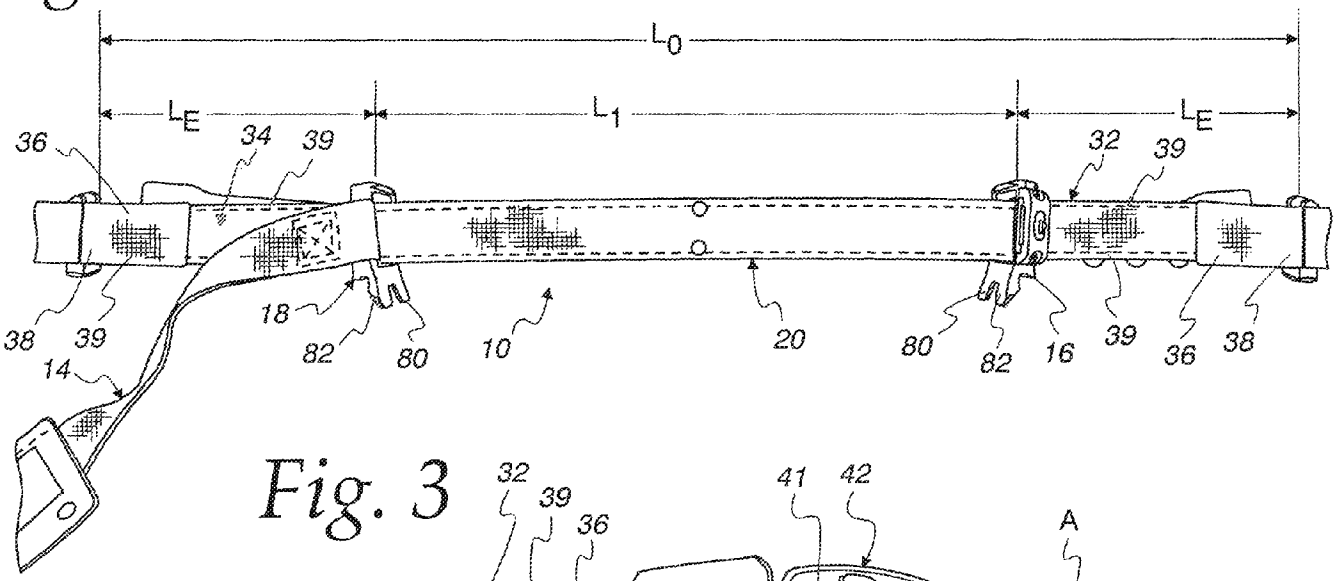
FIG. 2 is a view showing inside surfaces of the pole strap assembly with the pole strap assembly arranged to extend along the longitudinal axis of its outer strap.

Referring to the drawings, and more particularly to FIGS. 1 and 2, a lineman's pole strap assembly 10 comprises an outer strap 12 having a length $L_O$, a cross strap 14 secured at its ends to slide members 16, 18 which are slidably mounted on the outer strap 12, thus defining with an intermediate portion 20 of the outer strap 12 a closed loop which encircles a utility pole shown schematically at 22 in FIG. 1. The slide members 16,18 are connected to respective bias members or springs 24 and 25 under tension which serves to pull the slide members 16,18 toward each other along the outer strap 12 and so draw the cross strap 14 into tight frictional engagement with the near side of the pole (side of the pole closest to the user). Identically configured adjustable strap assemblies 26 extend from each end of the outer strap 12 and include releasable connectors in the form of snap hooks 28 of known construction that can be attached to rings provided on a user's body belt or harness (not shown). Another wear pad is provided on the cross strap 14 and can be translated along the strap 14 so as to be centered thereon after adjustments are made to the length of the strap 14.

As is conventional, the outer strap 12 is a pole strap made of relatively stiff but flexible material, such as synthetic fiber or leather, or composite rubber/leather material, and is adapted to extend around the far side of the utility pole (the side of the pole farthest from a user) when in use. A ribbed, rubber wear member or pad 30 extends over the length $L_I$ of the intermediate portion 20 on the inside surface of the outer strap 12 to provide additional grip/friction against the surface of a pole and to prevent wear on the inside surface of the outer strap 12. It will be appreciated that the wear pad 30 can be a separate component that is fixed to the outer strap 12 such as by lines of stitching 31 or could simply be a frictional material that is laminated or otherwise bonded to the inside surface of the outer strap 12.

Again with reference to FIGS. 1 and 2, identically configured end portions 32 and 34 of the outer strap 12 extend over a length $L_E$ from opposite sides of the intermediate portion 20 of the outer strap 12 and the wear pad 30. The end portions 32 and 34 serve as guide surfaces for the slides 16 and 18 as they translate along the outer strap 12 in response to a user pulling against the force of the springs 24 and 25. Each of the end portions 32 and 34 has a length of strap or webbing 36 extending over the entire length $L_E$ of the end portion 32, 34 on the outside surface of the outer strap 12 and at least a portion of the length $L_E$ of the end portion 32, 34 on the inside surface of the outer strap 12 to form a strap loop 38 immediately adjacent the corresponding end of the outer strap 12. The straps 36 are permanently fixed to their respective end portion 32, 34 using any suitable means and in the illustrated embodiment are sewn to the respective end portions 32 and 34 by lines of stitching 39. A stop in the form of a stop button or rivet 40 is provided on the outside surface of each of the end portions 32 and 34 to limit the translation of the slides 16, 18 along the end portions 32 and 34.

Figure 3:
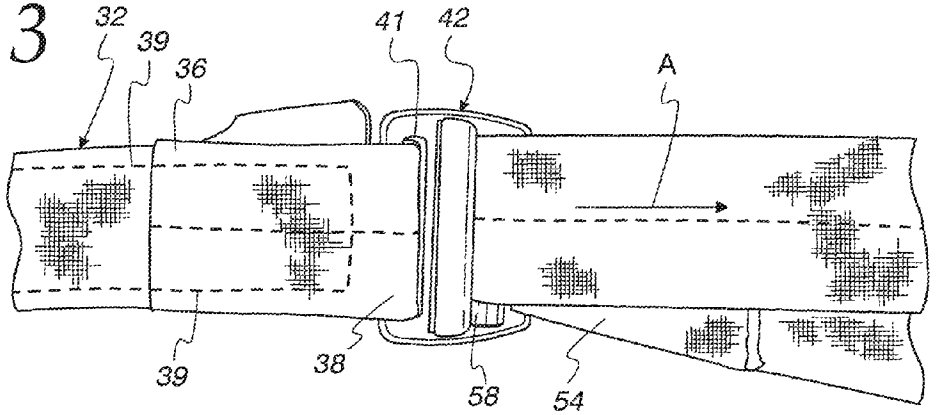
FIG. 3 is an enlarged view of portions of the pole strap assembly.
Figure 4:
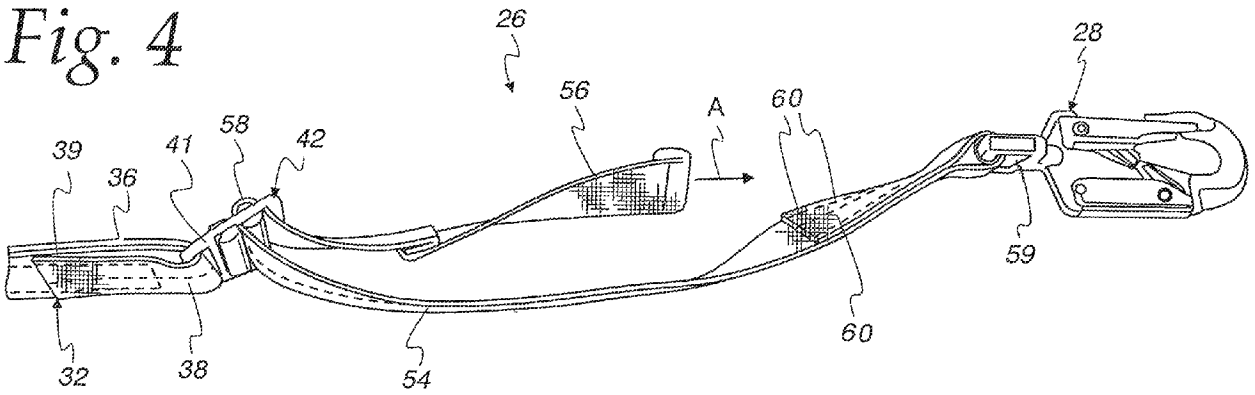
FIG. 4 is a somewhat enlarged view of an end portion of the outer strap and an adjustable strap assembly of the pole strap assembly.

As best seen in FIG. 3, each of the loops 38 extends through a mounting loop or opening 41 on a tension buckle 42 of known construction which is part of the corresponding adjustable strap assembly 26. As best seen in FIGS. 1 and 4, each of the adjustable strap assemblies 26 further includes an adjustment strap 54 extending between the tension buckle 42 and the releasable connector 28, with the strap 54 having an end 56 threaded through a spring loaded bite 58 on the tension buckle 42 and extending toward the releasable connector 28 such that forced movement of the end 56 towards the releasable connector (shown by arrow A in FIGS. 1, 3 and 4) urges the strap 54 through the bite 58 to shorten the length of the adjustable strap assembly (i.e., the distance between the corresponding end of the outer strap 12 and the connector 28). This allows for the user to be repositioned closer to the pole by action of the user pulling the ends 56 of the adjustment straps 54 toward the user rather than requiring the user to push adjustment strap ends away from the user as in conventional pole strap assemblies. As best seen in FIG. 4, the other end of each the adjustment straps 54 is looped through an opening or loop 59 in the connector 28 and fixed to itself such as by lines of stitching 60.

With reference again to FIG. 2, in some embodiments, including the illustrated embodiment, the length $L_O$ of the outer strap 12 is no more than twice the length $L_I$ of the wear pad 30. This insures that the length $L_E$ of each of the end portions 32 and 34 allows a lineman or other user to achieve as vertical a position as possible relative to a pole when the adjustable strap assemblies 26 are adjusted to their shortest length. In some embodiments, including the illustrated embodiment, the length $L_O$ of the outer strap 12 is 34 inches, the length $L_I$ of the wear pad 30 is 18 inches, and the length $L_E$ of each of the end portions is 8 inches, with the distance from the end of the wear pad 30 to the corresponding stop button 40 being 7 inches.

Figure 5:
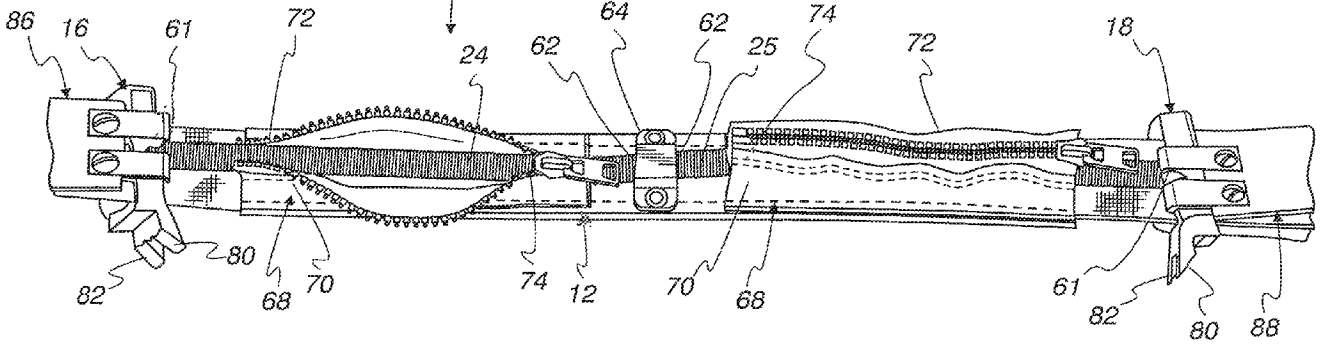
FIG. 5 is a somewhat enlarged view of an intermediate portion of the outer strap of the pole strap assembly and various other components carried thereon shown in particular states.
Figure 6:
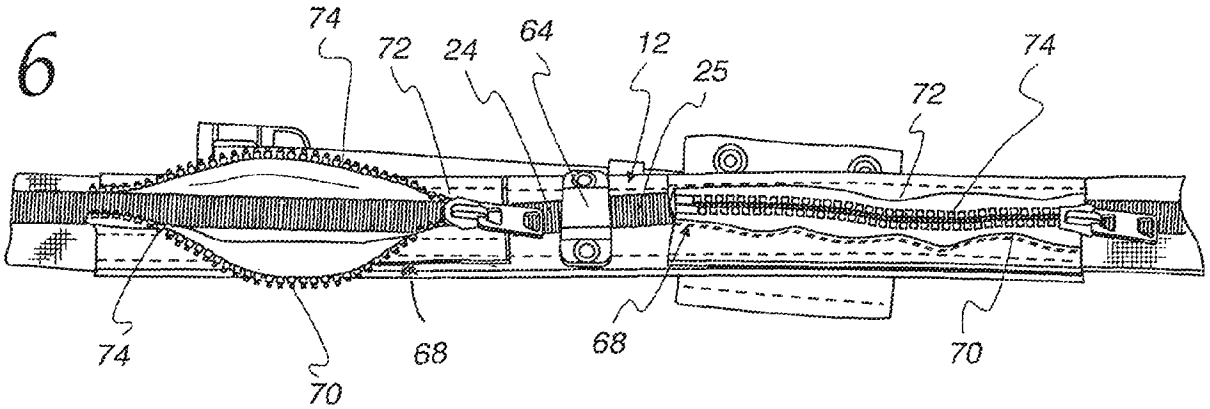
FIG. 6 is a view similar to FIG. 5 but is further enlarged.

As best seen in FIG. 5, the spring 24 and 25 are coil springs of a known construction in the illustrated embodiment, with each spring 24, 25 having one end 61 connected to the corresponding slide member 16, 18 and an opposite end 62 connected to a center spring anchor 64 of a known construction that fixes the end 62 relative to the outer strap 12 and also serves to electrically isolate the springs 24 and 25 from each other to prevent a continuous electrically conductive path from extending between the slide members 16 and 18. Each of the springs 24 and 25 extends through an elongate protective cover or tunnel 68 that covers almost the entire length of the corresponding spring 24, 25 when the springs are in a retracted position (shown in FIG. 1). As best seen in FIGS. 5 and 6, each of the tunnels 68 includes a first elongate side or wall member 70 and a second elongate side or wall member 72 fixed to the outer strap 12 along opposite lateral sides of the corresponding spring 24, 25, with the first and second wall members 70 and 72 having a first state wherein they are connected to each other to extend over the corresponding spring 24,25 (as shown on the right side of FIGS. 5 and 6) and a second state wherein they are disconnected from each other to allow inspection of the corresponding spring 24,25 (as shown on the left side of FIGS. 5 and 6). In this regard, in the illustrated embodiment, each of the tunnels 68 further includes a zipper 74 attached to a lateral edge of each of the wall members 70 and 72 to releasable connect the wall members 70 and 72 in the first state. It should be appreciated that other suitable releasable fasteners can be used in place of the zipper 74. In the illustrated embodiment, the wall members are made of suitable leather that is connected to the outer strap 12 by lines of stitching, but it should be understood that other materials and other types of connections could also be used.

Using the same operating principle as disclosed in the U.S. Pat. No. 5,141,074, during normal ascent and descent of the pole, the lineman or other such user must manually pull the slide members 16 and 18 against the force of the springs 24 and 25 to hold the cross strap 14 away from the pole so that the outer strap 12 can be manipulated in the normal manner. When the slide members 16 and 18 are released, as when the lineman reaches a working position, or in the event that he loses his footing while ascending or descending, the closed loop formed by the cross strap 14 and the outer strap 12 is closed into tight frictional engagement with the utility pole 14, thereby pulling gaffs 80 and 82 which are integral with each of the slide members 16 and 18 into biting engagement with the pole.

Figure 7:
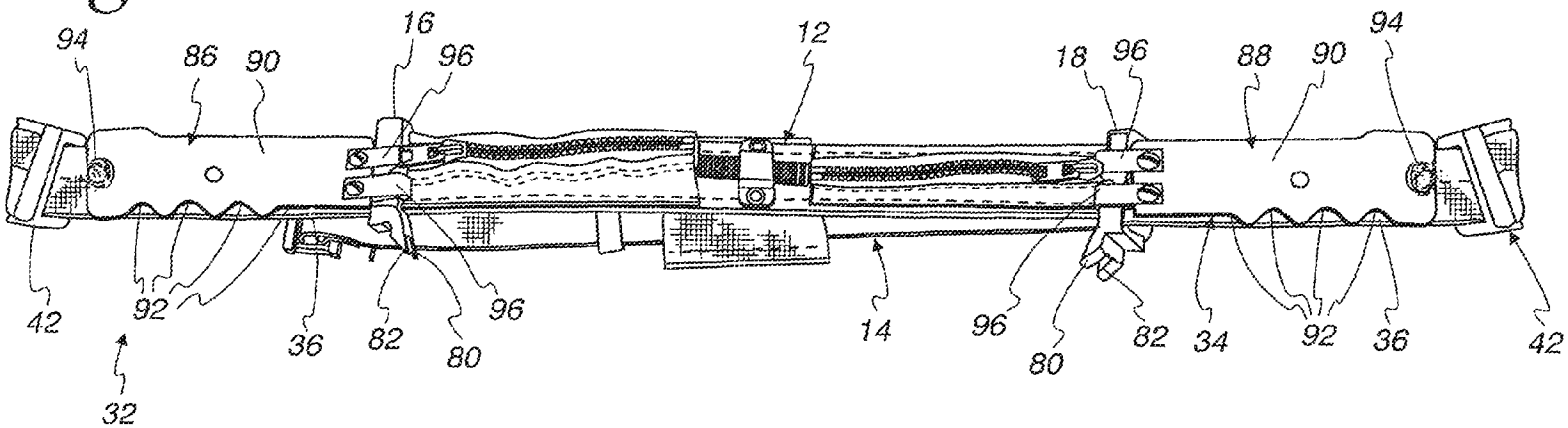
FIG. 7 is a view similar to FIG. 5 but showing selected components in a different state than FIG. 5.

Some embodiments of the assembly 10, including the illustrated embodiment as best seen in FIG. 7, include a pair of gaff pullers 86 and 88, with one of the gaff pullers 86 attached to the slide member 16 and the other of the gaff pullers attached to the slide member 18. Each of the gaff pullers 86 and 88 includes a relatively stiff, planar, elongate grip 90 sized for grasping engagement by the palms and fingers of a user's hand wearing a protective glove to allow a user to pull the slide members 16 and 18 against the force of the springs 24 and 25 to loosen the cross strap 14 from the pole. In this regard, each of the grips 90 includes a plurality of finger reliefs 92 that assist in maintaining a grasp on the gaff puller 86, 88 and further include a stop rivet or button 94 adjacent the free end of the grip 90. In the illustrated embodiment, each of the grips is formed from a Nylon 3-ply belt material or from a suitable leather and includes a pair of elongate tabs 96 that are looped around a lateral side wall of the corresponding slide member 16, 18 to attach the grip 90 to the slide member 16, 18.

Figure 8:
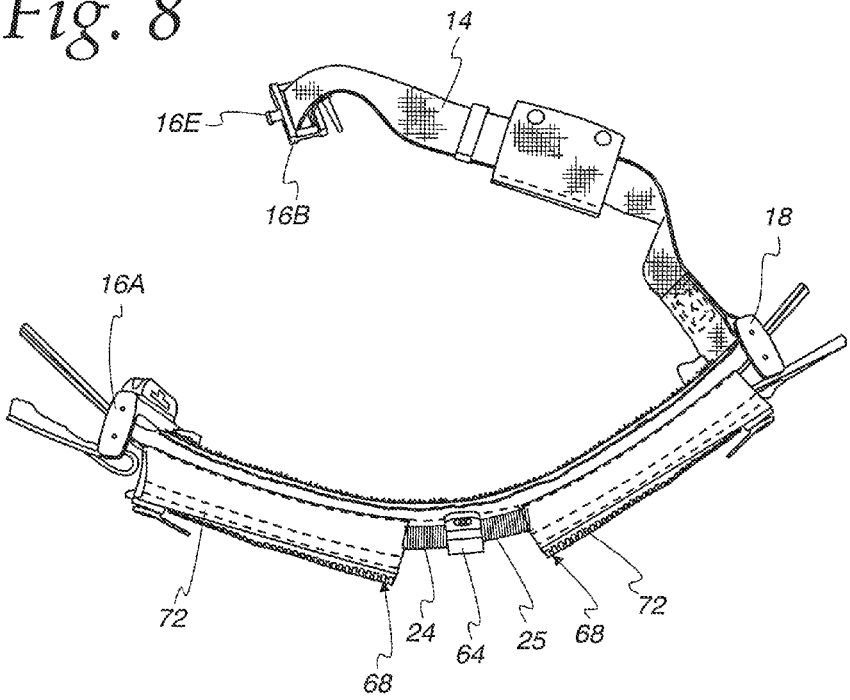
FIG. 8 is a somewhat enlarged view similar to FIG. 1, but showing a cross strap in an open state.
Figure 9:
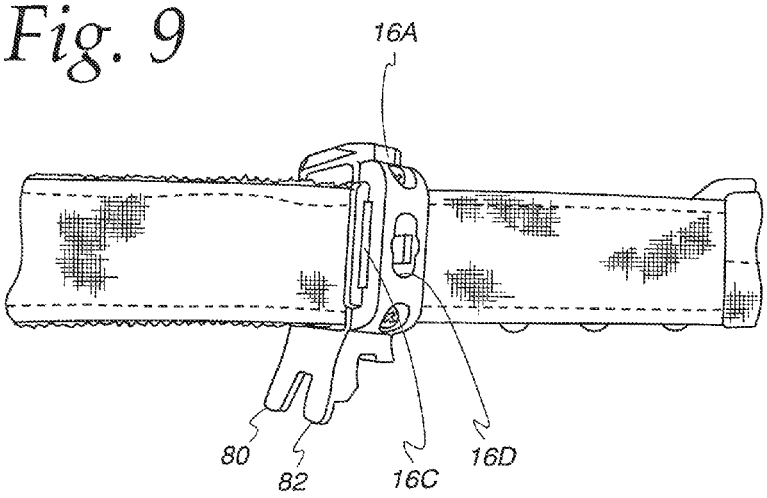
FIG. 9 is an enlarged view of selected components of the pole strap assembly.
Figure 10:
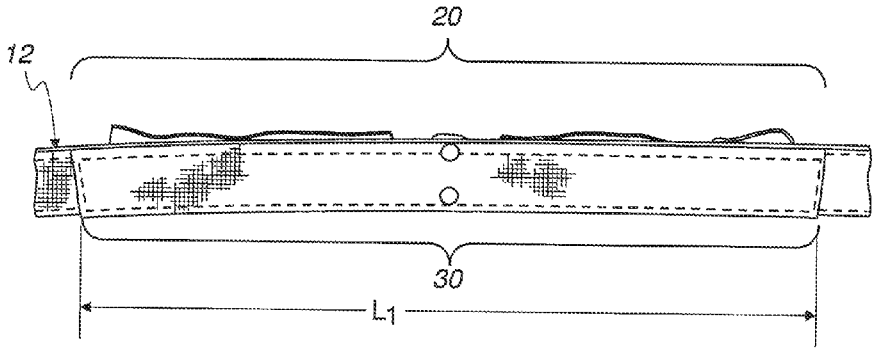
FIG. 10 is a view similar to FIG. 2, but is further enlarged.
Figure 11:
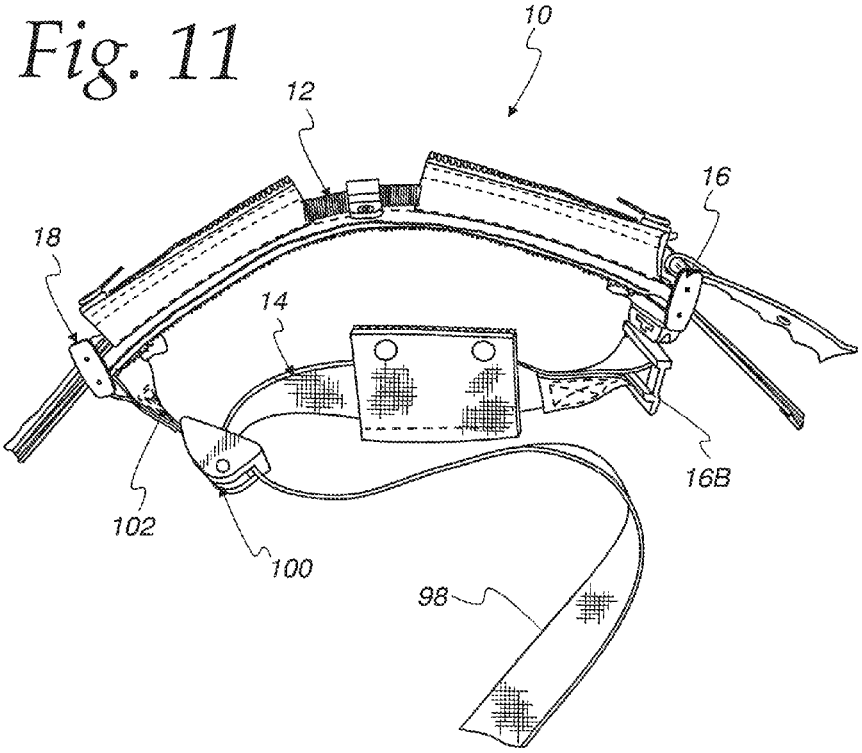
FIG. 11 is a view from above showing an alternate arrangement for a cross strap of the pole strap assembly.
Figure 12:
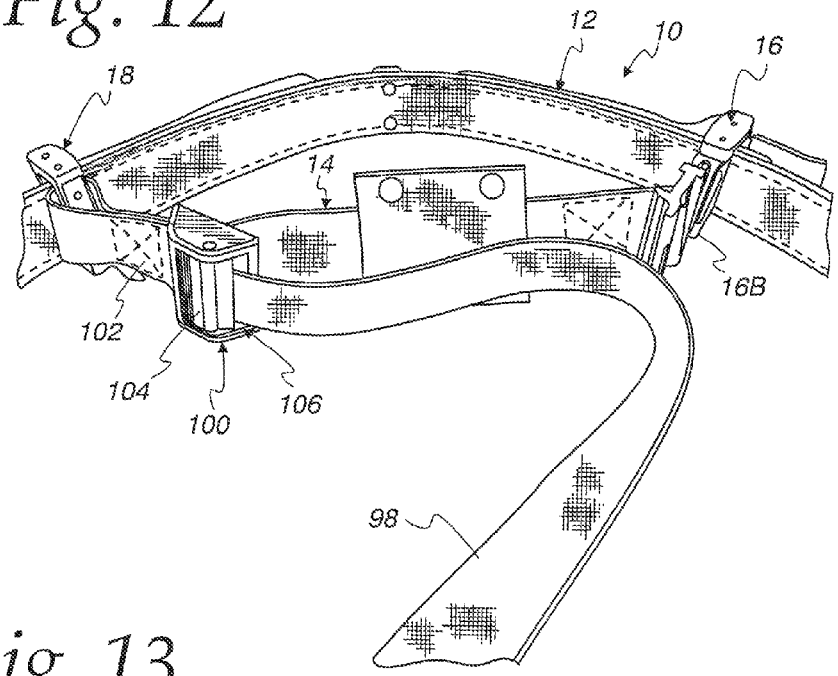
FIG. 12 is similar to FIG. 11, but is an enlarged view and at a slightly different angle.
Figure 13:
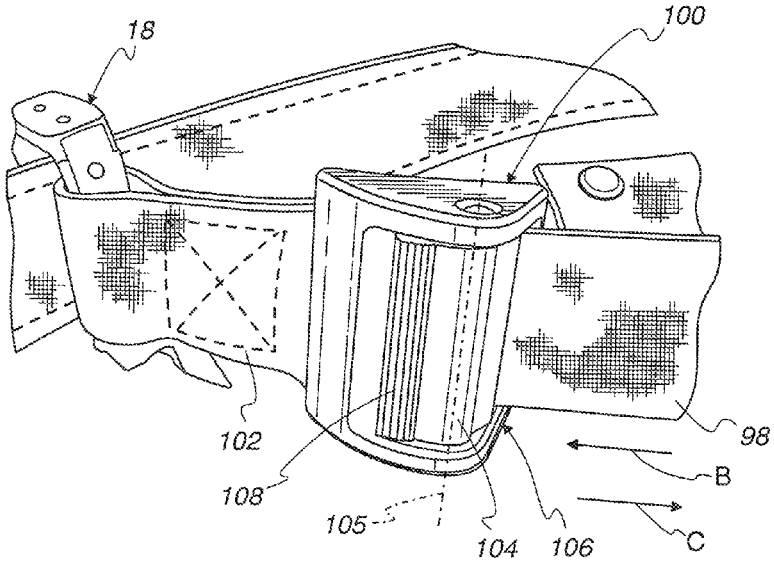
FIG. 13 is a further enlarged view showing a cam buckle of the embodiment of FIGS. 11 and 12.
Figure 14:
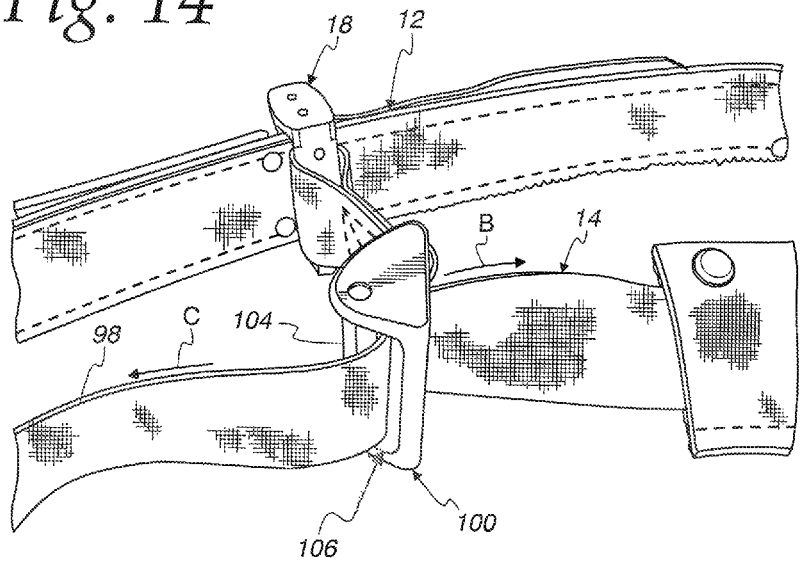
FIG. 14 is another view of the cam buckle of FIG. 13.
Figure 15:
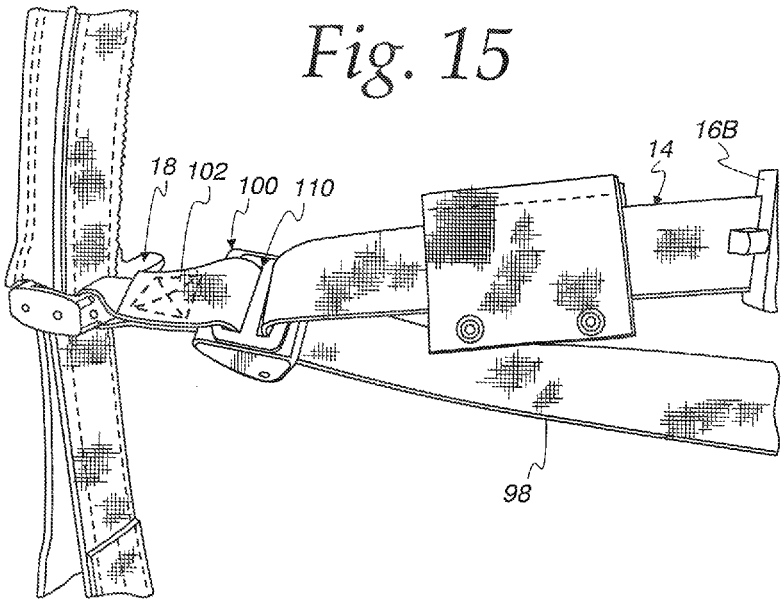
FIG. 15 is yet another view of the cam buckle of FIG. 13.
Figure 16:
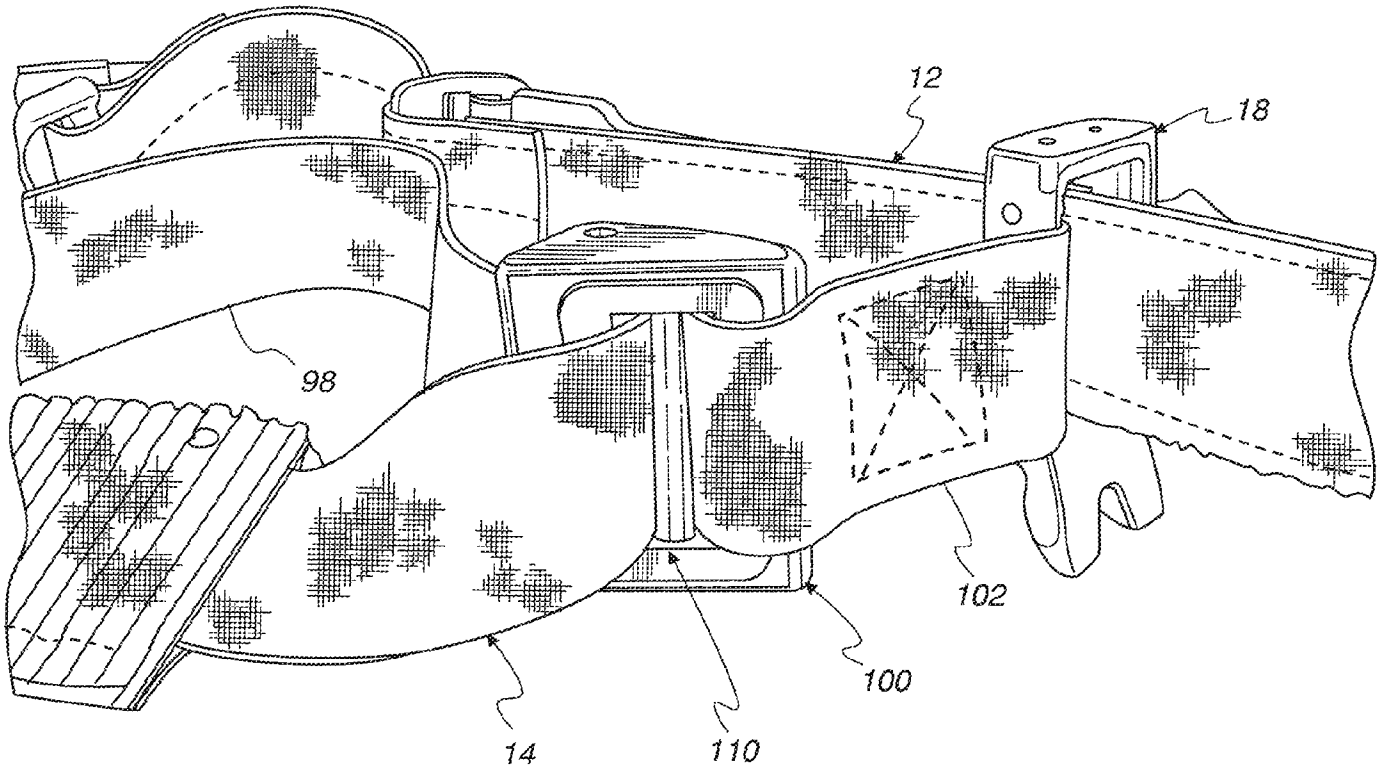
FIG. 16 is yet another view of the cam buckle of FIG. 13.

It is desirable that the cross strap 14 be capable of being fastened and unfastened. While this can be achieved by forming the cross strap in two parts to fasten together, in the illustrated embodiment, one end of the cross strap 14 is attached to the outer strap 12 by means of the slide member 16, which has a known construction as a two-part releasable coupling used in the previously mentioned Miller® Stop-Fall™ Fall Restraint System that are similar to that described in U.S. Pat. No. 5,141,074. In the construction illustrated herein and as best seen in FIG. 8, one coupling member 16A is slidably mounted on the outer strap 12 while the other coupling member 16B is attached to one end of the cross strap 14. The coupling member 16A includes a pair of rollers or pins defining a slot through which the outer strap 12 extends. As best seen in FIG. 9, the member 16A includes a yoke with an internal groove 16C which communicates with an external key slot 16D at right angles to it. The key slot 16D is adapted to receive a correspondingly shaped head pin 16E extending from the coupling member 16B. One end of the cross strap 14 is fastened to the coupling member 16B which provides a pair of additional slots forming an adjustment bite through which the end portion of the cross strap 14 extends, the arrangement being such that the length of the cross strap 14 can readily be adjusted. To fasten the coupling, a lineman or other such user inserts the headed pin 16E into the key slot 16D, turns the members 16A and 16B through 90° relative to each other and releases the member 16B so that the head pin 16E becomes nested in the groove 16C where it is retained by a leaf spring.

The other slide member 18 comprises a yoke with a pair of rollers or pins mounted so as to define a slot through which the outer strap 12 passes, with the other end of the cross strap 14 being permanently attached directly to the slide member 18.

FIGS. 11-16 illustrate another embodiment of the pole strap assembly 10 having an alternate configuration for the cross strap 14 shown in FIGS. 1-10. In this embodiment, one end of the cross strap 14 is fixed to the coupling member 16*b*, rather than being adjustably fastened as in the embodiment of FIGS. 1-10, and the other end 98 of the cross strap 14 is threaded through a cam buckle 100 to provide an improved adjustability of the cross strap 14 in comparison to the embodiment of FIGS. 1-10 which utilizes a friction buckle. The cam buckle 100 is permanently attached to a short length of strapping 102 that itself is permanently attached to the slide member 18. The cam buckle 100 is of a known design and includes a spring loaded cam member 104 that is mounted to pivot on about an axis 105 and to form a strap holding bite 106, with the spring loading biasing the cam member 104 in a direction that tightens the bite 106 onto the strap 14. The axis 105 of the cam member 104 is located relative to the bite 106 such that movement of the strap 14 in the direction indicated by arrow "B" pivots the cam member 104 in a direction that tightens the bite 106 onto the strap 14, while movement of the strap 14 in the direction indicated by arrow "C" pivots the cam member 104 in a direction that loosens the bite 106 on the strap 14 thereby allowing the strap 14 to be tightened onto the near side of the pole. A ribbed push tab 108 is provided on the cam member 104 and allows a single hand of a user to pivot the cam member 104 in a direction that loosens the bite 106 and allows the strap 14 to move freely through the cam buckle 100 for a one handed adjustment of the cross strap 14. The end 98 of the cross strap 14 is threaded through a metallic rimmed guide opening 110 in the back of the cam buckle 100 before passing through the bite 106 of the cam member 104. Location of the cam buckle 100 on the left side of the pole strap assembly 10 allows the cam strap 14 to be adjusted by a user into proper engagement with the near side of a pole by grasping the end 98 of the cross strap 14 with the right hand of the user and pulling the cross strap 14 towards the right side of a user.

While any suitable materials may be used, in some embodiments of the pole strap assembly 10, the straps 36 and 54 are 8,000 lb. tensile polyester strap or web, and the outer strap 12 is a Goodyear belting material which meets or exceeds CSA Standard Z259.14-01 and Z259.3-M 1978, and the structural components of the slides 16 and 18, the tension buckles 42, the connectors 28, and the stop buttons 40 and 94 are steel or stainless steel.

It should further be appreciated that while specific constructions have been shown herein, other specific constructions are possible to achieve the features of the pole strap assembly 10 and that no limitation to a specific construction of any component is intended unless expressly recited in any claims.

The invention claimed is:

1. A pole strap assembly for use in climbing a utility pole, the pole strap assembly comprising:

an outer strap to wrap around a far side of a pole from a user utilizing the pole strap assembly, the outer strap including opposite end portions connected by an intermediate portion; and an elongate wear member attached to and extending over at least part of the intermediate portion of the outer strap to engage the far side of the pole, wherein the wear member does not extend over the end portions, and the outer strap has a total length LO and the elongate wear member has a length LI, with the length LO being no greater than twice the length LI.

2. The pole strap assembly of claim 1 wherein the LO is about 16 inches greater than LI.

3. The pole strap assembly of claim 1 wherein the ratio of LO/LI is about 1.8.

4. The pole strap assembly of claim 1 wherein each of the end portions has a length LE that is about 7 inches.

5. The pole strap assembly of claim 1 further comprising a pair of slides, each slide mounted to translate along a corresponding one of the opposite end portions of the outer strap.

6. The pole strap assembly of claim 5 further comprising a cross strap to extend across a near side of a pole opposite from the far side of a pole, the cross strap having a first end carried on one of the slides to allow movement of the first end along the outer strap and an opposite end carried on the other of the slides to allow movement of the opposite end along the outer strap.

7. The pole strap assembly of claim 6 further comprising at least one bias member mounted between the slides and the outer strap to urge translation of the slides toward each other along the outer strap.

8. A pole strap assembly for use in climbing a utility pole, the pole strap assembly comprising:

an outer strap to wrap around a far side of a pole from a user utilizing the pole strap assembly, the outer strap including opposite end portions connected by an intermediate portion;

an elongate wear member attached to and extending over at least part of the intermediate portion of the outer strap to engage the far side of the pole, wherein the wear member does not extend over the end portions, and the outer strap has a total length LO and the elongate wear member has a length LI, with the length LO being no greater than twice the length LI;

a pair of slides, each slide mounted to translate along a corresponding one of the opposite end portions of the outer strap;

a cross strap to extend across a near side of a pole opposite from the far side of a pole, the cross strap having a first end carried on one of the slides to allow movement of the first end along the outer strap and an opposite end carried on the other of the slides to allow movement of the opposite end along the outer strap;

at least one bias member mounted between the slides and the outer strap to urge translation of the slides toward each other along the outer strap; and at least one elongate protective cover fixed on the outer strap and extending over the at least one bias member, the protective cover includes first and second elongate wall members fixed to the outer strap along opposite lateral sides of the at least one bias member, with the first and second elongate wall members having a first state wherein they are connected to each other to extend over the at least one bias member and a second state wherein they are disconnected from each other to allow inspection of the at least one elongate bias member.

9. The pole strap assembly of claim 1 further comprising a pair of adjustable strap assemblies fixed to opposite ends of the outer strap and having adjustable lengths, each of adjustable strap assemblies including a tension buckle fixed to one of the opposite ends of the outer strap, a releasable connector to connect to a harness or belt worn by a user, and an adjustment strap extending between the tension buckle and the releasable connector, the adjustment strap having an end threaded through a bite on the tension buckle to extend toward the releasable connector such that movement of the end toward the releasable connector shortens the length of the adjustable strap assembly.

10. A pole strap assembly for use in climbing a utility pole, the pole strap assembly comprising:

an outer strap to wrap around a far side of a pole from a user utilizing the pole strap assembly, the outer strap including opposite end portions connected by an intermediate portion;

a cross strap connected to the outer strap to wrap around a near side of the pole, the cross strap having a first end attached to a one of the end portions of the outer strap and a second end extending through a cam buckle attached to the other of the end portions of the outer strap, the second end threaded through a bite on the cam buckle configured for single handed operation by a user to loosen the bite to allow the cross strap to move freely though the cam buckle for one handed adjustment of the cross strap; and further comprising an elongate wear member attached to and extending over at least part of the intermediate portion of the outer strap to engage the far side of the pole, wherein the wear member does not extend over the end portions, and the outer strap has a total length LO and the elongate wear member has a length LI, with the length LO being no greater than twice the length LI.

11. The pole strap assembly of claim 10 further comprising a pair of slides, each slide mounted to translate along a corresponding one of the opposite end portions of the outer strap, the first end of the cross strap attached to the one of the end portions by one of the slides the cam buckle attached to the other of the end portions by the other one of the slides.

12. The pole strap assembly of claim 11 further comprising at least one bias member mounted between the slides and the outer strap to urge translation of the slides toward each other along the outer strap.

13. The pole strap assembly of claim 10 wherein the ratio of LO/LI is about 1.8.

14. The pole strap assembly of claim 10 wherein each of the end portions has a length LE that is about 7 inches.

* * * * *